US008842138B2

(12) United States Patent
Lee et al.

(10) Patent No.: US 8,842,138 B2
(45) Date of Patent: Sep. 23, 2014

(54) LIQUID CRYSTAL DISPLAY AND METHOD OF DRIVING THE SAME

(75) Inventors: Junghwan Lee, Gyeonggi-do (KR); Euiyeol Oh, Seoul (KR); Kyungjoon Kwon, Seoul (KR); Kyohyuck Choo, Gyeonggi-do (KR); Changkyun Park, Incheon (KR)

(73) Assignee: LG Display Co., Ltd., Seoul (KR)

( * ) Notice: Subject to any disclaimer, the term of this patent is extended or adjusted under 35 U.S.C. 154(b) by 842 days.

(21) Appl. No.: 12/829,531

(22) Filed: Jul. 2, 2010

(65) Prior Publication Data

US 2011/0122168 A1 May 26, 2011

(30) Foreign Application Priority Data

Nov. 25, 2009 (KR) ..... 10-2009-0114590

(51) Int. Cl.
*G09G 5/10* (2006.01)
*G09G 3/34* (2006.01)

(52) U.S. Cl.
CPC ..... *G09G 3/3426* (2013.01); *G09G 2360/16* (2013.01); *G09G 2320/0646* (2013.01)
USPC ..... 345/690; 345/102

(58) Field of Classification Search
USPC ..... 345/102, 690
See application file for complete search history.

(56) References Cited

U.S. PATENT DOCUMENTS

| | | | | |
|---|---|---|---|---|
| 6,486,900 | B1 * | 11/2002 | Shen et al. | 715/867 |
| 8,111,238 | B2 * | 2/2012 | Park et al. | 345/102 |
| 8,120,569 | B2 * | 2/2012 | Jou et al. | 345/102 |
| 8,207,953 | B2 * | 6/2012 | Yamamura et al. | 345/204 |
| 2006/0164379 | A1 * | 7/2006 | Oh et al. | 345/102 |
| 2008/0252666 | A1 * | 10/2008 | Chen et al. | 345/690 |
| 2009/0015536 | A1 * | 1/2009 | Takeoka et al. | 345/99 |

FOREIGN PATENT DOCUMENTS

| | | | |
|---|---|---|---|
| CN | 1797082 | A | 7/2006 |
| CN | 101286300 | A | 10/2008 |
| CN | 101494033 | A | 7/2009 |
| TW | 200813948 | A | 3/2008 |
| TW | 200919431 | A | 5/2009 |
| TW | 200933586 | A | 8/2009 |

OTHER PUBLICATIONS

Taiwan: Office Action for Taiwanese Patent Application No. 099122395—Issued on Jul. 19, 2013.

* cited by examiner

*Primary Examiner* — Sumati Lefkowitz
*Assistant Examiner* — Joseph Fox
(74) *Attorney, Agent, or Firm* — Morgan, Lewis & Bockius LLP

(57) ABSTRACT

Disclosed are a liquid crystal display and a method of the liquid crystal display. The liquid crystal display includes a liquid crystal panel, a backlight unit that supplies light to the liquid crystal panel and has a plurality of light sources, and an image calibration unit that calculates a global dimming resultant value and a local dimming resultant value for an image data signal inputted to the liquid crystal panel, analyzes an average picture level for each block with respect to the image data signal, and determines a convex combination parameter based on the global dimming resultant value, the local dimming resultant value, and the average picture level to generate a calibration dimming value for the backlight unit and an image calibration value for the image data signal.

13 Claims, 10 Drawing Sheets

(a) IMAGE SUBJECTED TO GLOBAL DIMMING (b) IMAGE SUBJECTED TO LOCAL DIMMING (c) IMAGE SUBJECTED TO DIMMING ACCORDING TO EMBODIMENT (a) IMAGE SUBJECTED TO GLOBAL DIMMING (b) IMAGE SUBJECTED TO LOCAL DIMMING (c) IMAGE SUBJECTED TO DIMMING ACCORDING TO EMBODIMENT

LIQUID CRYSTAL DISPLAY AND METHOD OF DRIVING THE SAME

This application claims the benefit of Korean Patent Application No. 10-2009-0114590 filed on Nov. 25, 2009, which is hereby incorporated by reference.

BACKGROUND

1. Field

This document relates to a liquid crystal display and a method of driving the liquid crystal display.

2. Description of the Related Art

Liquid crystal display gain popularity because of characteristics, such as light weight, compactness, and low power consumption. A transmissive liquid crystal display controls an electric field applied to a liquid crystal layer and modulates light emitted from a backlight unit to display an image.

A driving method of a liquid crystal display includes a global dimming method and a local dimming method that have been developed to enhance image quality. The global dimming method analyzes the entire image displayed on a screen to determine the driving amount of the entire backlight unit and applies the same gain value to the whole pixels. By doing so, the global dimming method may reduce power consumption and enhance contrast ratio as well as display a bright image. The local dimming method partitions a backlight into a plurality of logical blocks and determines the driving amount for each of the blocks independently from the others, thereby applying different pixel values for the blocks. In most cases, the local dimming method enjoys lower power consumption and higher contrast ratio than the global dimming method. However, the local dimming method may cause a 'halo' phenomenon that a bright portion makes a dark portion appear to float especially when the dark portion is located adjacent to the bright portion. Further, the local dimming method may cause grayscale banding at the bright portion around the dark portion due to insufficient brightness of the dark portion.

SUMMARY

According to an embodiment of the present invention, there is provided a liquid crystal display including: a liquid crystal panel; a backlight unit that supplies light to the liquid crystal panel and has a plurality of light sources; and an image calibration unit that calculates a global dimming resultant value and a local dimming resultant value for an image data signal inputted to the liquid crystal panel, analyzes an average picture level for each block with respect to the image data signal, and determines a convex combination parameter based on the global dimming resultant value, the local dimming resultant value, and the average picture level to generate a calibration dimming value for the backlight unit and an image calibration value for the image data signal.

According to an embodiment of the present invention, there is provided a liquid crystal display including: a liquid crystal panel; a backlight unit that supplies light to the liquid crystal panel and has a plurality of light sources, the backlight unit being driven in a global dimming scheme and a local dimming scheme; and an image calibration unit that analyzes a low grayscale for an image data signal inputted to the liquid crystal panel and makes a weight value of one of a global dimming value and a local dimming value different from the other to generate a dimming value of the backlight unit.

According to an embodiment of the present invention, there is provided method of driving a liquid crystal display including: calculating a global dimming resultant value and a local dimming resultant value for an image data signal inputted to the liquid crystal panel; analyzing an average picture level for each block with respect to the image data signal; determining a convex combination parameter based on the global dimming resultant value, the local dimming resultant value, and the average picture level; and generating a calibration dimming value for the backlight unit and an image calibration value for the image data signal to control a backlight unit.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Reference will now be made in detail embodiments of the invention examples of which are illustrated in the accompanying drawings.

Hereinafter, embodiments of the present invention will be described with reference to the accompanying drawings.

Figure 1:
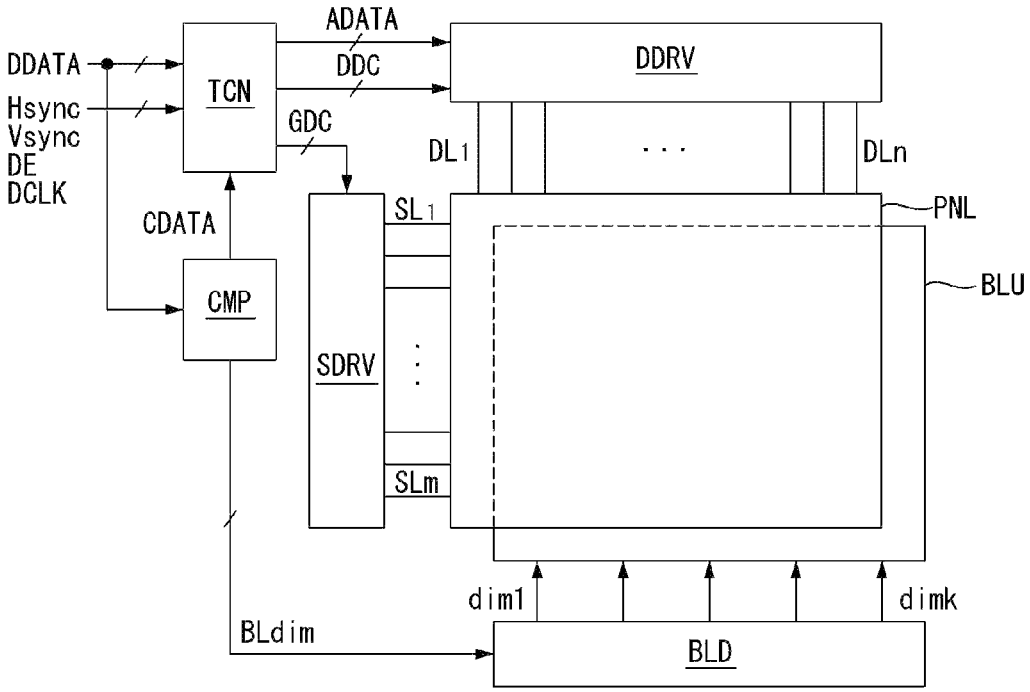
FIG. 1 is a block diagram illustrating a liquid crystal display according to an embodiment of the present invention.
Figure 2:
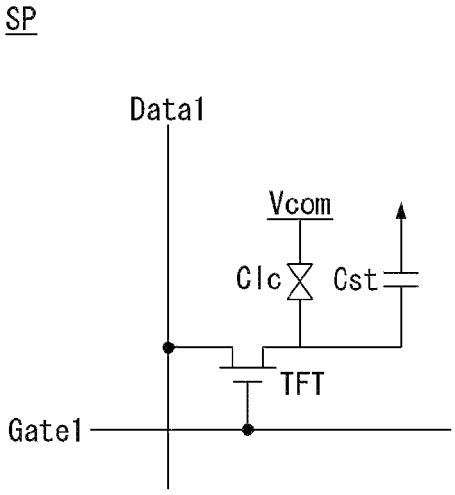
FIG. 2 is a circuit diagram illustrating a sub pixel included in the liquid crystal panel shown in FIG. 1.
Figure 3:
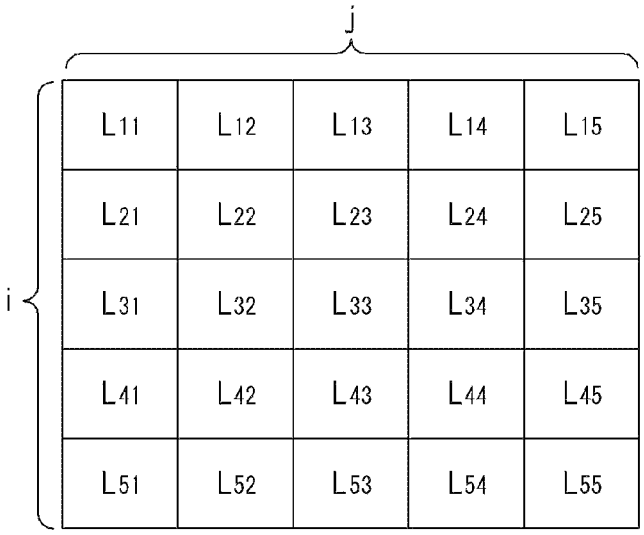
FIG. 3 is a view illustrating a construction of a backlight unit.
Figure 4:
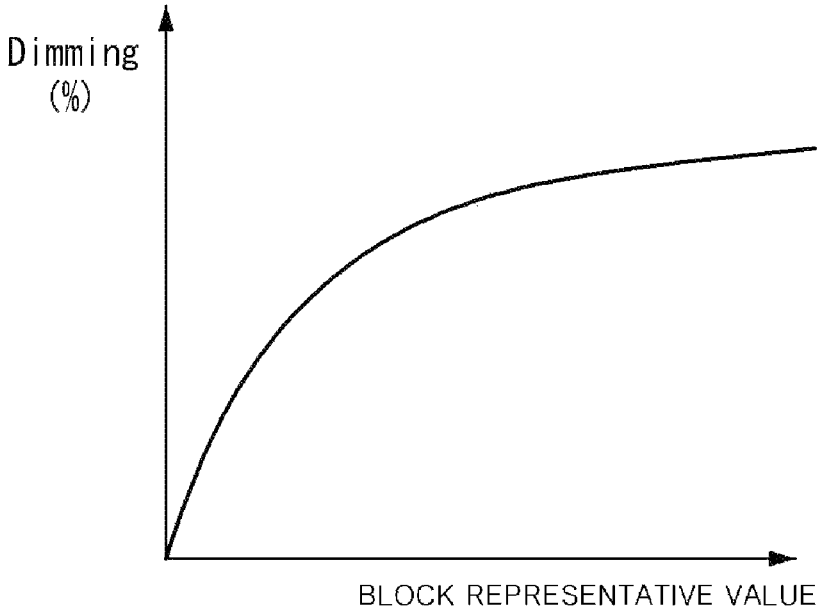
FIGS. 4 and 5 are graphs illustrating a dimming curve.
Figure 5:
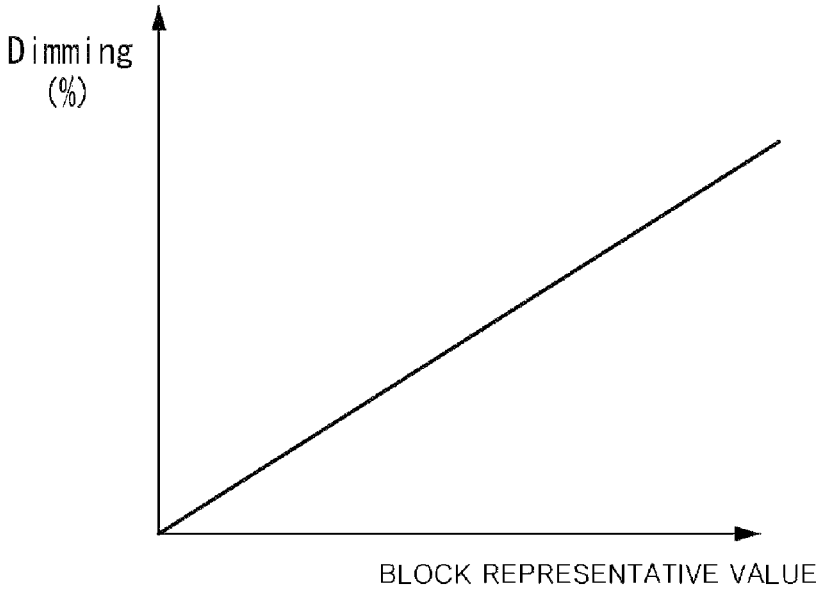

FIG. 1 is a block diagram illustrating a liquid crystal display according to an embodiment of the present invention. FIG. 2 is a circuit diagram illustrating a sub pixel included in the liquid crystal panel shown in FIG. 1. FIG. 3 is a view illustrating a construction of a backlight unit. FIGS. 4 and 5 are graphs illustrating a dimming curve.

Referring to FIG. 1, a liquid crystal display includes a timing driver TCN, a data driver DDRV, a gate driver SDRV, an image calibration unit CMP, a liquid crystal panel PNL, a backlight unit BLU, and a backlight unit driver BLD.

The timing driver TCN receives timing signals including a vertical sync signal Vsync, a horizontal sync signal Hsync, a data enable signal DE, a clock signal CLK, and a image data signal DDATA from an external source (not shown). The timing driver TCN controls the operational timing of the data driver DDRV and the gate driver SDRV based on the timing signals. The timing driver TCN may determine a frame period by counting the data enable signal DE during one horizontal period and thus the vertical sync signal Vsync and the horizontal sync signal Hsync may be omitted. The timing driver TCN generates control signals including a gate timing control signal GDC for controlling the operational timing of the gate driver SDRV and a data timing control signal DDC for controlling the operational timing of the data driver DDRV. The gate timing control signal GDC may include a gate start pulse GSP, a gate shift clock GSC, and a gate output enable signal GOE. The gate start pulse GSP is supplied to a gate drive IC ("Integrated Circuit") that generates a first gate signal. The gate shift clock GSC is a clock signal that is commonly inputted to the gate drive ICs to shift the gate start pulse GSP. The gate output enable signal GOE controls the output of the gate drive ICs. The timing control signal DDC may include a source start pulse SSP, a source sampling clock SSC, and a source output enable signal SOE. The source start pulse SSP controls a start time point of data sampling of the data driver DDRV. The source sampling clock SSC is a clock signal that controls the data sampling operation in the data driver DDRV based on a rising edge or a falling edge. The source output enable signal SOE controls the output of the data driver DDRV. The source start pulse SSP supplied to the data driver DDRV may be omitted depending on the data transmission scheme.

The data driver DDRV samples and latches a digital image data signal DDATA supplied from the timing driver TCN in response to the data timing control signal DDC supplied from the timing driver TCN to convert the image data signal DDATA to parallel data. For this purpose, the data driver DDRV may include a shift register, a latch storing the digital image data signal DDATA with reference to a signal received from the shift register, a converter converting the image data signal DDATA received from the latch to an analog data signal ADATA, and an output buffer outputting the data signal ADATA outputted from the converter, but is not limited thereto. The data driver DDRV supplies the converted data signals ADATA to the liquid crystal panel PNL through data lines DL1 to DLn.

The gate driver SDRV sequentially generates gate driving voltages in response to the gate timing control signal GDC supplied from the timing driver TCN. For this purpose, the gate driver SDRV may include a shift register, a level shifter adjusting the level of a signal received from the shift register, and an output buffer outputting a signal received from the level shifter, but not limited to. The gate driver SDRV supplies gate signals to the liquid crystal panel PNL through gate lines SL1 to SLm.

The liquid crystal panel PNL includes a transistor substrate (referred to as "TFT substrate"), a color filter substrate, and a liquid crystal layer. The liquid crystal panel PNL includes sub pixels arranged in a matrix pattern. The TFT substrate includes at least one data line, at least one gate line, at least one TFT, and at least one storage capacitor. The color filter substrate includes at least one black matrix and at least one color filter. One sub pixel SP is arranged near an intersection of the data line Data1 and the gate line Gate1. The sub pixel SP includes the TFT driven in response to a gate signal supplied through the gate line Gate1, the storage capacitor Cst storing a data signal supplied through the data line Data1 as a data voltage, and a liquid crystal cell Clc driven by the data voltage stored in the storage capacitor Cst. The liquid crystal cell Clc is driven by a data voltage supplied to the pixel electrode and a common voltage Vcom supplied to the common electrode. The common electrode is formed on the color filter substrate in the liquid crystal displays driven in a vertical electric field driving method, such as a TN ("Twisted Nematic") mode and a VA ("Vertical Alignment") mode, and on the TFT substrate together with the pixel electrode in liquid crystal displays driven in a horizontal electric field driving method, such as an IPS ("In Plane Switching") mode and an FFS ("Fringe Field Switching") mode. A polarizing plate is attached on each of the TFT substrate and the color filter substrate of the liquid crystal panel PNL. The liquid crystal panel PNL may include an alignment film for setting the pre-tilt angle of liquid crystal molecules. The liquid crystal mode of the liquid crystal panel PNL may include the TN mode, the VA mode, the IPS mode, and the FFS mode, but not limited to as mentioned above.

The backlight unit BLU supplies light to the liquid crystal panel PNL. As shown in FIG. 3, the backlight unit BLU includes a plurality of light sources L11 to L55 that may include n or more blocks. The light sources L11 to L55 are arranged in the matrix pattern (i, j). The light source may include at least one of an HCFL ("Hot Cathode Fluorescent Lamp"), a CCFL ("Cold Cathode Fluorescent Lamp"), an EEFL ("External Electrode Fluorescent Lamp"), and an LED ("Light Emitting Diode"). The backlight unit BLU may include a light guide plate, a diffusing plate, a prism sheet, a lens sheet, and a protection sheet to effectively supply light.

The backlight unit driver BLD controls the light sources of the backlight unit BLU on a per-block basis using dimming signals dim1 to dimk, such as pulse width modulation ("PWM") varying a duty ratio according to a calibration dimming value BLdim supplied from the image calibration unit CMP. The dimming signals dim1 to dimk include global dimming signals and local dimming signals. A global dimming method may enhance a dynamic contrast ratio that is measured between a previous frame and the next frame. On the contrary, a local dimming method locally controls the brightness of an image data signal during one frame period to enhance a static contrast ratio that is difficult for the global dimming method to improve. The local dimming method selects a representative value of each block for an inputted image data signal and maps the representative value to a dimming curve to select a dimming value (%) for each block. For example, the dimming values selected by the local dimming method may appear in the form of a curve shown in FIG. 4 or FIG. 5. In FIGS. 4 and 5, the X axis refers to the representative value for each block and the Y refers to dimming values (%). In FIG. 4, as the gray scale increases, the dimming value (%) exponentially increases. In FIG. 5, however, as the gray scale increases, the dimming value (%) is linearly increased in proportion to the gray scale. The lights of the backlight unit BLU may vary the On/Off ratio and the brightness depending on the form of the dimming curve.

The image calibration unit CMP generates a calibration dimming value of the backlight unit and an image calibration value CDATA of the image data signal by calculating resultant values obtained by performing global dimming and local dimming on the image data signal DDATA inputted to the liquid crystal panel PNL; analyzing the per-block average picture level ("APL") for the image data signal DDATA; and determining a convex combination parameter based on the calculated global dimming resultant value, the local dimming resultant value, and the analyzed per-block average picture level. For this purpose, the image calibration unit CMP may calculate an average image level, analyze a difference value in the calculated average picture level between neighboring blocks, and determine the convex combination parameter based on the local dimming resultant value and the difference value. When the brightness difference between the calculated average picture level and the neighboring block is large, the image calibration unit CMP increases a weight value for the global dimming resultant value, and when the brightness difference is smaller, decreases a weight value for the local dimming resultant value.

A liquid crystal display will now be described in greater detail.

Figure 6:
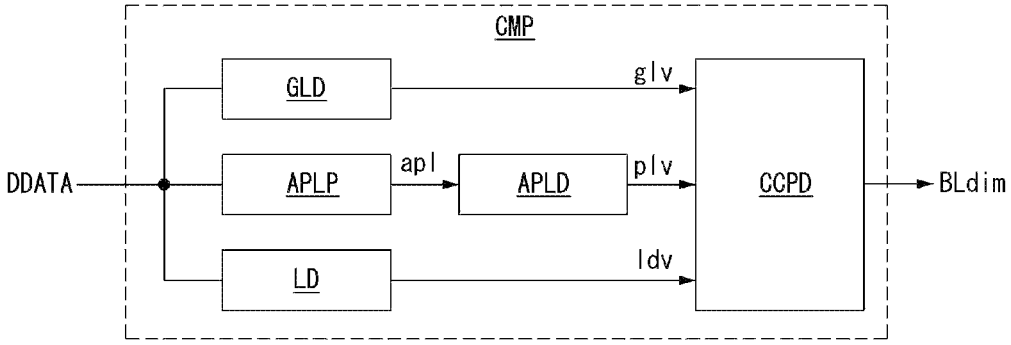
FIG. 6 is a block diagram schematically illustrating an image calibration unit included in a liquid crystal display according to an embodiment of the present invention.
Figure 7:
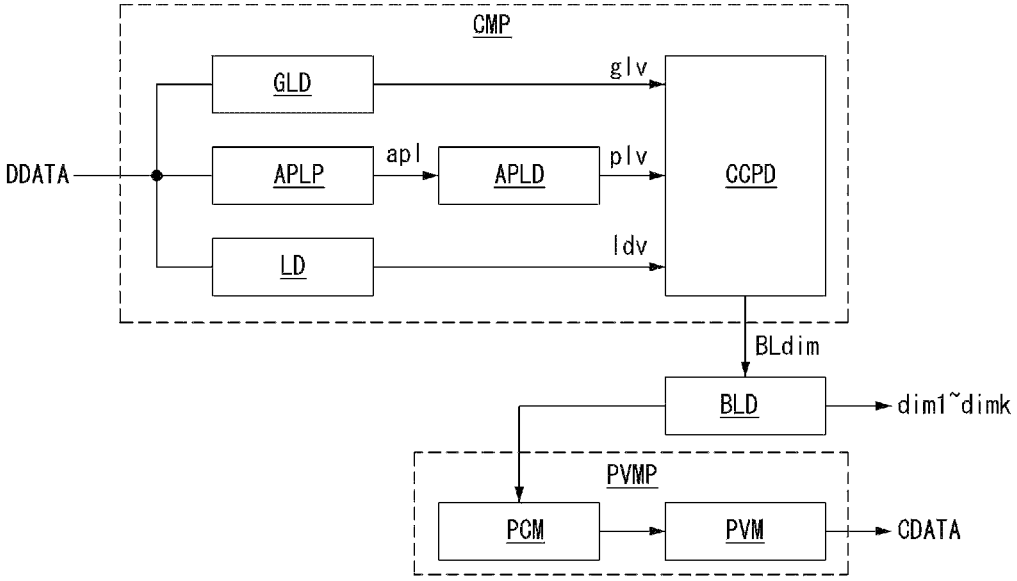
FIG. 7 is a block diagram illustrating a device interworking with an image calibration unit.

FIG. 6 is a block diagram schematically illustrating an image calibration unit included in a liquid crystal display according to an embodiment of the present invention, and FIG. 7 is a block diagram illustrating a device interworking with an image calibration unit.

Referring to FIG. 6, the image calibration unit CMP includes a global dimming resultant value calculating unit GLD that calculates a global dimming resultant value glv, a local dimming resultant value calculating unit LD that calculates a local dimming resultant value ldv, a per-block average picture level calculating unit APLP that calculates an average picture level apl, an average picture level difference value analyzing unit APLD that analyzes a difference value plv in the calculated average picture level between neighboring blocks, and a convex combination parameter determining unit CCPD that determines a convex combination parameter based on the calculated global dimming value glv, the local dimming resultant value ldv, and the difference value plv.

The global dimming resultant value calculating unit GLD determines the brightness and the degree of achievable pixel compensation for the whole image data signals, lowers the whole brightness of the backlight unit BLU to a compensatable level in the same ratio, and calculates the global dimming resultant value glv so that the lowered level may be calibrated by pixel compensation.

The local dimming resultant value calculating unit LD determines the driving level of each of the light source blocks obtained by logically partitioning the backlight unit BLU depending on the brightness and the degree of achievable pixel compensation of an image data signal outputted to the light source block and calculates the local dimming resultant value ldv so that pixel compensation may be performed.

The per-block average picture level calculating unit APLP calculates an average brightness value of the pixels for an inputted image data signal. The per-block average picture level calculating unit APLP calculates a logical per-block average picture level distinguished from the others upon local dimming.

The average picture level difference value analyzing unit APLD calculates the difference in the calculated average picture level between neighboring blocks and the number of blocks showing the difference, and analyzes the result, i.e., the difference value plv.

The convex combination parameter determining unit CCPD puts a weight value on the global dimming when it is determined based on the global dimming resultant value glv, the local dimming resultant value ldv and the difference value plv that the brightness difference between the neighboring blocks is large, and puts a weight on the local dimming when it is determined that the brightness difference is not large, thereby capable of maintaining an improved contrast ration on one screen. The calibration dimming value BLdim of the backlight unit BLU by the convex combination parameter determining unit CCPD of the image calibration unit CMP may be mathematically defined as follows:

$$\dim(i,j)=\alpha\cdot\dim_{GD}+(1-\alpha)\cdot\dim_{LD}(i,j) \quad \text{[Equation 1]}$$

Here, 'dim(i, j)' refers to a dimming value of the backlight unit, 'dimGD' refers to the degree of the driven backlight unit upon global dimming, and 'dimLD(i, j)' refers to the degree of the driven backlight unit according to the position of a light source upon local dimming. 'a' may have a relationship as follows: $0 \le a \le 1$.

'a' may have a value of 0 to k (k is a real number more than 0 and less than or equal to 1) when the difference value is small, and a value of k to 1 when the difference value is large.

As mentioned above, the image calibration unit CMP analyzes the difference value plv that is a difference in average picture level between the neighboring blocks. When the difference value plv is large, that is, a halo (a circle of light or group of light circles shown round a luminous body) may seriously occur, more weight is given to the global dimming resultant value glv calculated by the global dimming resultant value calculating unit GLD.

As such, because the difference value ply is large, 'a' in Equation 1 may have a value of 0.5 to 1 so that more weight is given to the global dimming resultant value glv. On the contrary, when the difference value ply is small, that is, a halo is less likely to occur, more weight is given to the local dimming resultant value ldv calculated by the local dimming resultant value calculating unit LD.

As such, because the difference value plv is small, 'a' in Equation 1 may have a value of 0 to 0.5 so that more weight is given to the local dimming resultant value ldv. Since 'a' may be represented as a value of 0 to k or k to 1, 'a' may be represented as a value of 0.2 to 1 when the difference value plv is large and a value of 0 to 2 when the difference value plv is small, or may be represented as a value of 0.8 to 1 when the difference value plv is large and a value of 0 to 0.8 when the difference value plv is small. Without being limited thereto, however, 'a' may be represented as other values.

As shown in FIG. 7, the image calibration unit CMP generates a calibration dimming value BLdim by linearly mixing global dimming with local dimming based on the global dimming resultant value glv, the local dimming resultant value ldv, and the difference value plv to minimize the effect of a halo, reduce consumption power, and enhance contrast ratio.

The image calibration unit CMP may interwork with the backlight unit driver BLD and the backlight unit driver BLD may interwork with a calibration amount adjustment unit PVMP. The PVMP includes a calibration amount calculation unit PCM that calculates a per-block pixel calibration amount based on the calibration dimming value BLdim and a pixel value adjustment unit PVM that generates the image calibration value CDATA for each pixel based on the calibration amount calculated by the pixel value adjustment unit PCM. The calibration amount adjustment unit PVMP may be included in any one of the timing driver TCN, the image calibration unit CMP, and the backlight unit driver BLD, but not limited to.

The calibration dimming value BLdim generated by the image calibration unit CMP is supplied to the backlight unit driver BLD. The backlight unit driver BLD generates dimming signals dim1 to dimk to drive the backlight unit BLU in global dimming and local dimming schemes based on the calibration dimming value BLdim. Further, the backlight unit driver BLD supplies dimming information based on the calibration dimming value BLdim to the calibration amount adjustment unit PVMP. Then, the calibration amount adjustment unit PVMP calculates a per-block pixel calibration amount based on the calibration dimming value BLdim of the backlight unit BLU and generates the image calibration value CDATA for each pixel. Accordingly, the data signal ADATA supplied to the liquid crystal panel PNL is calibrated according to the image calibration value CDATA generated for each pixel.

Hereinafter, an image displayed on a liquid crystal display according to a comparative example and an image displayed on a liquid crystal display according to an embodiment of the present invention will be compared to each other.

Figure 8:
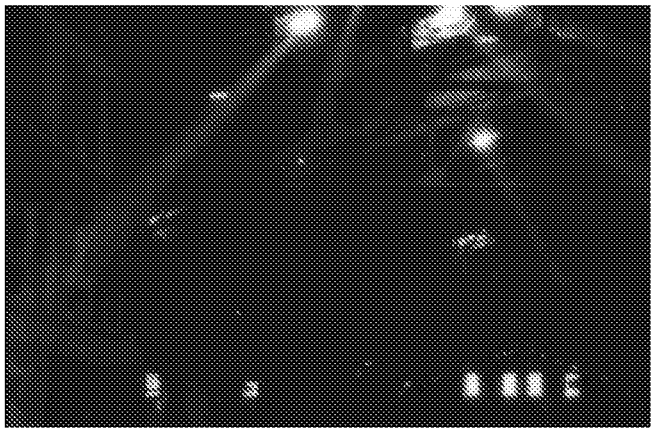
FIG. 8 depicts images that may seriously cause a problem of gray scale banding and a halo.
Figure 8:
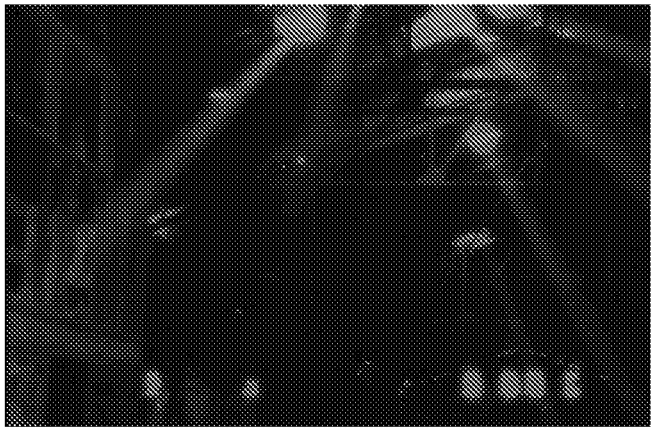
Figure 8:
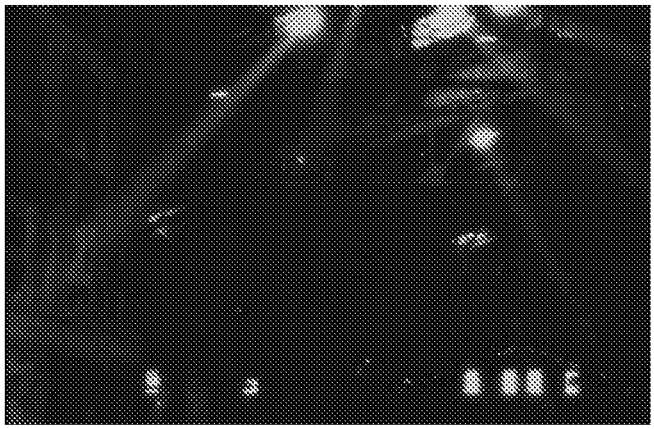
Figure 9:
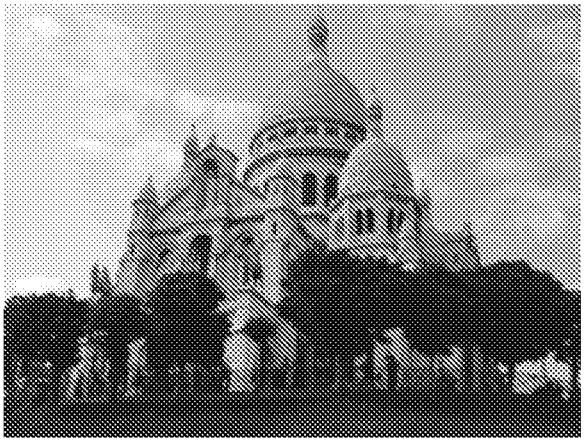
FIG. 9 depicts images without gray scale banding and a halo.
Figure 9:
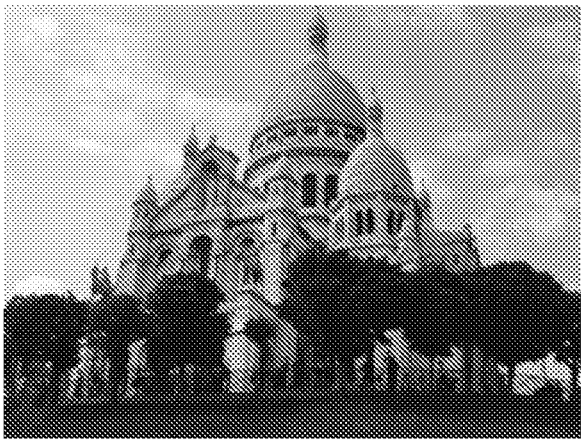
Figure 9:
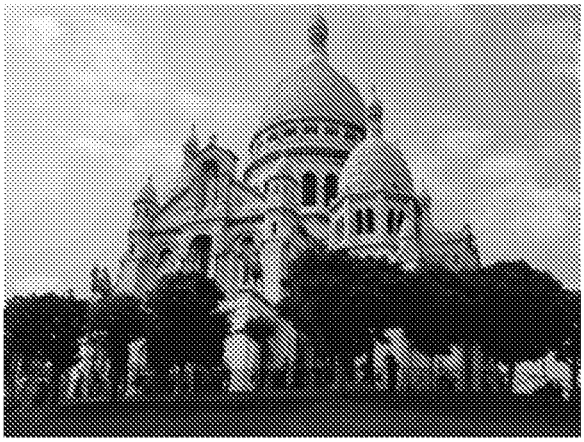

FIG. 8 depicts images that may seriously cause a problem of gray scale banding and a halo, and FIG. 9 depicts images without gray scale banding and a halo.

FIGS. 8A and 9A are views illustrating images displayed on a liquid crystal display according to a comparative example, when being subjected to a global dimming process, FIGS. 8B and 9B are views illustrating images displayed on a liquid crystal display according to a comparative example, when being subjected to a local dimming process, and FIGS. 8C and 9C are views illustrating images displayed on a liquid crystal display according to an embodiment of the present invention, when being subjected to a convex combination dimming process.

FIG. 8 depicts images that may seriously cause a problem of gray scale banding and a halo. The gray scale banding is easily noticeable from the images. Particularly, the image according to the comparative example, which was subjected only to the local dimming process, shows considerable gray scale banding. The image according to the comparative example, which was subjected only to the global dimming process, shows a phenomenon in which a dark portion seems to relatively float. Unlike these, the image according to the embodiment, which was subjected to the convex combination dimming process, does not show noticeable gray scale banding similarly to a result obtained by applying the global dimming process since more weight is given to the global dimming process. In the image according to the embodiment, further, a dark portion can become darker since the local dimming process still affects the image.

FIG. 9 depicts images without gray scale banding and a halo. It can be seen through the images that a dark tree image processed by local dimming has a deeper color than a dark tree image processed by global dimming. It can be identified that the convex combination dimming process according to the embodiment gives more weight to the local dimming than the global dimming to maintain the improved contrast ratio achieved by the local dimming.

When the image data signal DDATA is a motion image, the image calibration unit CMP of the liquid crystal display according to an embodiment may analyze a low gray scale in a letter box of the motion image to raise the weight value for global dimming resultant value glv respective of the weight value for the local dimming resultant value ldv. The detailed description will be made later.

Accordingly, the embodiment of the present invention may alleviate a problem of gray scale banding and a halo while maintaining an improved contrast ratio by determining the degree of applying global dimming and local dimming schemes to backlight modulation and pixel calibration of a liquid crystal display based on convex combination parameters.

Figure 10:
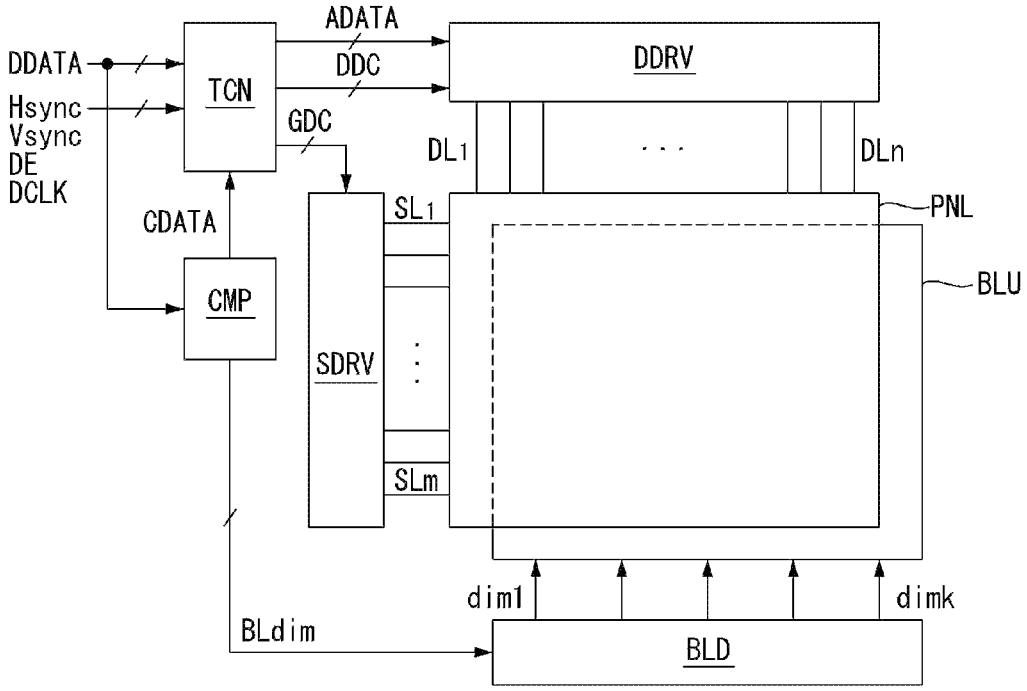
FIG. 10 is a block diagram schematically illustrating a liquid crystal display according to an embodiment of the present invention.
Figure 11:
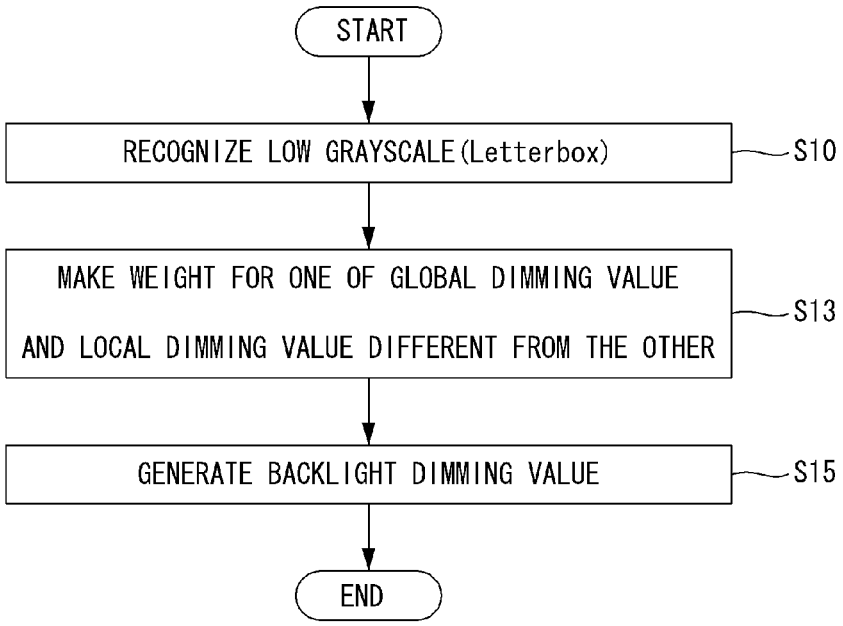
FIG. 11 is a flowchart illustrating the driving of the image calibration unit shown in FIG. 10.
Figure 12:
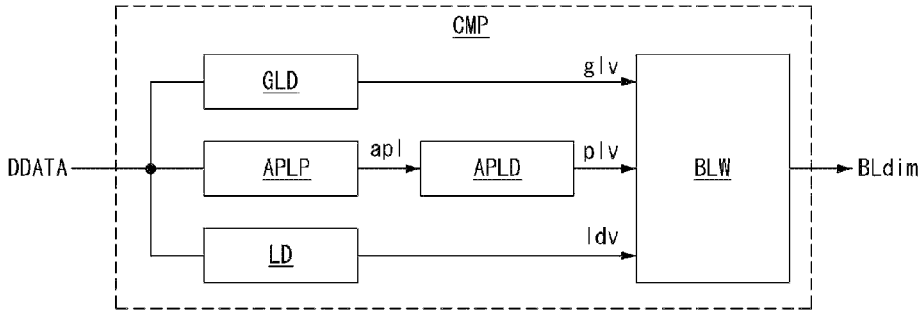
FIG. 12 is a block diagram schematically illustrating an image calibration unit.
Figure 13:
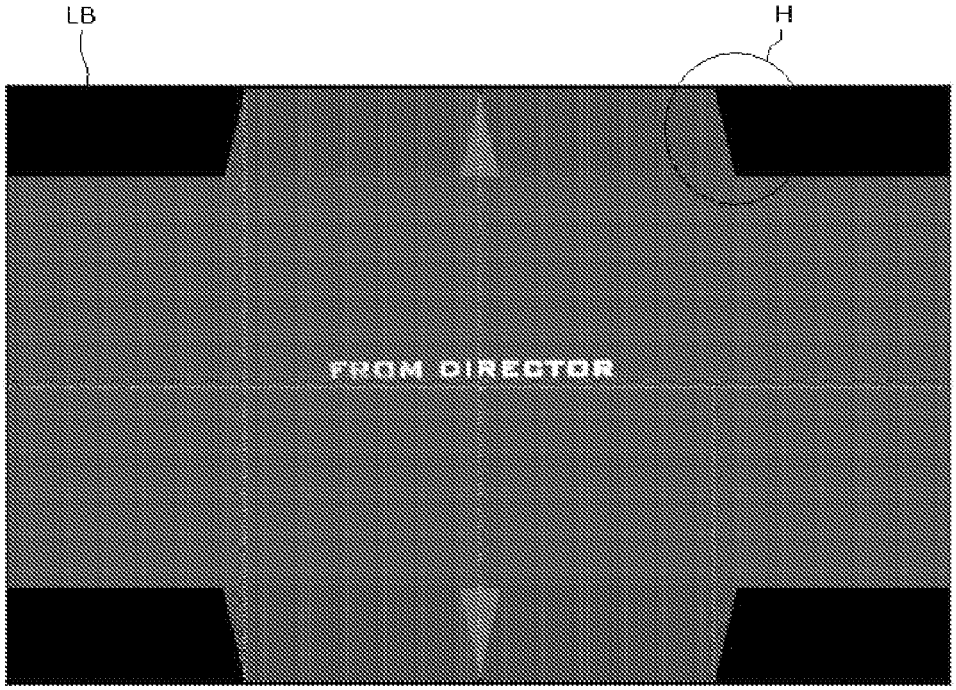
FIG. 13 is a view illustrating a halo generated while performing a local dimming process on an edge portion of a motion image.
Figure 14:
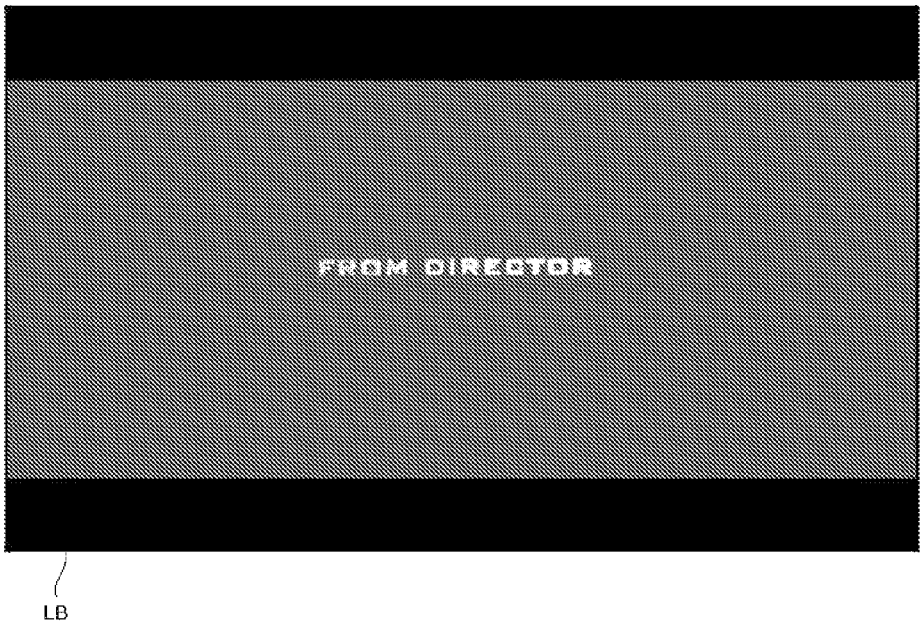
FIGS. 14 and 15 are views illustrating the alleviation of a halo according to an embodiment of the present invention.
Figure 15:
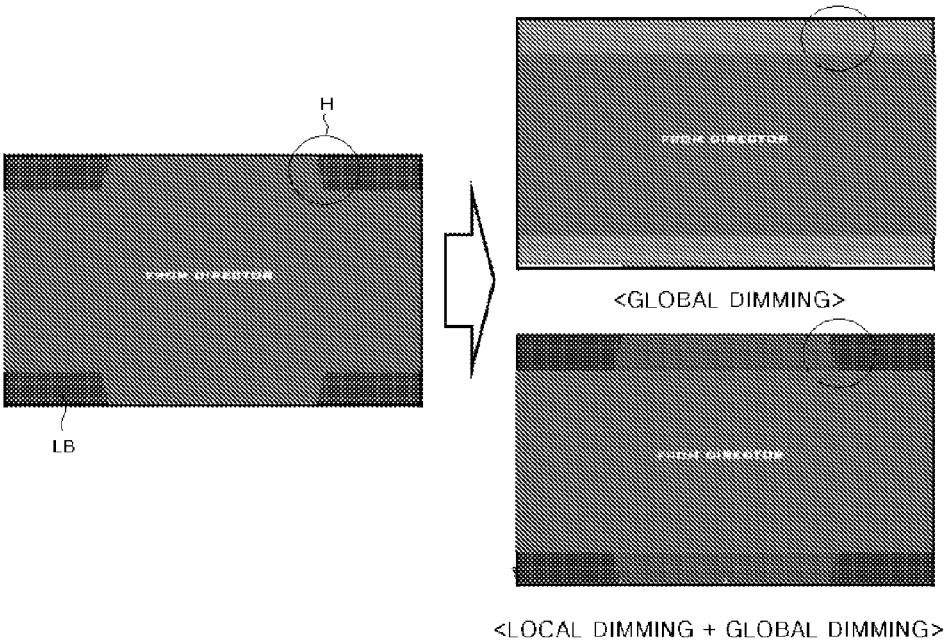

FIG. 10 is a block diagram schematically illustrating a liquid crystal display according to an embodiment of the present invention. FIG. 11 is a flowchart illustrating the driving of the image calibration unit shown in FIG. 10. FIG. 12 is a block diagram schematically illustrating an image calibration unit. FIG. 13 is a view illustrating a halo generated while performing a local dimming process on an edge portion of a motion image. FIGS. 14 and 15 are views illustrating the alleviation of a halo according to an embodiment of the present invention.

Referring to FIG. 10, a liquid crystal display includes a timing driver TCN, a data driver DDRV, a gate driver SDRV, an image calibration unit CMP, a liquid crystal panel PNL, a backlight unit BLU, and a backlight unit driver BLD. The timing driver TCN, the data driver DDRV, the gate driver SDRV, the liquid crystal panel PNL, the backlight unit BLU, and the backlight unit driver BLD are identical or similar to those according to the embodiment described in connection with FIGS. 1 to 9.

Referring to FIGS. 10 and 11, the image calibration unit CMP analyzes a low gray scale for an image data signal DDATA inputted to the liquid crystal panel PNL (S10) and makes a weight value for one of a global dimming value and a local dimming value different from the other (S13) to generate a dimming value for the backlight unit BLU (S15). When the image data signal DDATA is a motion image, the image calibration unit CMP may analyze a low gray scale in a letter box of the motion image to raise the weight value for global dimming resultant value respective of the weight value for the local dimming resultant value.

For this purpose, the image calibration unit CMP, as shown in FIG. 12, may include a global dimming resultant value calculating unit GLD that calculates a global dimming resultant value glv, a local dimming resultant value calculating unit LD that calculates a local dimming resultant value ldv, a per-block average picture level calculating unit APLP that calculates an average picture level apl, an average picture level difference value analyzing unit APLD that analyzes a difference value plv in the calculated average picture level between neighboring blocks, and a weight determining unit BLW that raises the weight of the global dimming value irrespective of the weight of the local dimming value based on the calculated global dimming value glv, the local dimming resultant value ldv, and the difference value plv, but not limited to. The weight determining unit may be replaced by the convex combination parameter determining unit CCPD according to the embodiment described in connection with FIGS. 1 to 9.

When only the edge portion is subjected to local dimming as shown in FIG. 13, light is scattered from the edge portion of the liquid crystal panel PNL to the central portion. When an image displayed on the liquid crystal panel PNL is a motion image, a phenomenon by light emitted from the backlight unit BLU, that is, halos H, occur at the letterboxes LB which are located around the corners of the screen.

When an image data signal is a motion image, the image calibration unit CMP analyzes a low gray scale at the letterbox LB of the motion image as shown in FIG. 14 and increases the weight value for the global dimming value respective of the weight for the local dimming value as shown in FIG. 15, so that the calibration dimming value BLdim may be varied for each block, thus preventing or reducing the halo H.

Accordingly, the embodiment described in connection with FIGS. 10 to 15 may lower the weight of the local dimming and raises the weight of the global dimming when the edge portion is only subjected to the local dimming, thus alleviating the halo that is generated under the low gray scale (for example, letterbox).

As described above, a liquid crystal display according to an embodiment of the present invention may prevent gray scale banding and a halo while maintaining an improved contrast ratio by using one or a mixed scheme of a global dimming scheme and a local dimming scheme according to an image data signal. Thus, the liquid crystal display may improve image quality and save power consumption.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A liquid crystal display, comprising:

a liquid crystal panel;

a backlight unit that supplies light to the liquid crystal panel and has a plurality of light sources; and an image calibration unit that calculates a global dimming resultant value and a local dimming resultant value for an image data signal inputted to the liquid crystal panel, analyzes an average picture level for each block with respect to the image data signal, and determines a convex combination parameter based on the global dimming resultant value, the local dimming resultant value, and the average picture level to generate a calibration dimming value for the backlight unit and an image calibration value for the image data signal, wherein the calibration dimming value is defined in the following equation:

$$\dim(i,j)=\alpha\cdot\dim_{GD}+(1-\alpha)\cdot\dim_{LD}(i,j)$$

where 'dim(i, j)' refers to a dimming value of the backlight unit, 'dimGD' refers to the degree of the driven backlight unit upon global dimming, 'dimLD(i, j)' refers to the degree of the driven backlight unit according to the position of a light source upon local dimming, and 'a' has a relationship as follows: $0<a<1$, whereby the calibration dimming value is a mixing of the global and local dimming resultant values, wherein the image calibration unit calculates the average picture level and analyzes a difference value in the average picture level between neighboring blocks, wherein the image calibration unit increases a weight value for the global dimming resultant value when the difference value in the average picture level between the neighboring blocks is large, and the image calibration unit increases a weight value for the local dimming resultant value when the difference value of the average picture level between the neighboring blocks is small.

2. The liquid crystal display of claim 1, wherein $0<a\leq k$ (k is a real number more than 0 and less than 1) when the difference value is small and $k\leq a<1$ when the difference value is large.

3. The liquid crystal display of claim 1, wherein the image calibration unit includes:

a global dimming resultant value calculating unit that calculates the global dimming resultant value;

a local dimming resultant value calculating unit that calculates the local dimming resultant value;

a per-block average picture level calculating unit that calculates the average picture level;

an average picture level difference value analyzing unit that analyzes a difference value in the calculated average picture level between neighboring blocks; and a convex combination parameter determining unit that determines the convex combination parameter based on the calculated global dimming value, the local dimming resultant value, and the difference value.

4. The liquid crystal display of claim 1, further comprising:

a backlight unit driver that drives the backlight unit based on the calibration dimming value of the backlight unit; and a calibration amount adjustment unit that calculates a per-block pixel calibration amount based on the calibration dimming value of the backlight unit and generates the image calibration value for each pixel.

5. The liquid crystal display of claim 1, wherein when the image data signal is a motion image, the image calibration unit analyzes a low gray scale at a letterbox of the motion image to raise the weight value for the global dimming resultant value respective of the weight value for the local dimming resultant value.

6. The liquid crystal display of claim 1, wherein the weight value for the global dimming resultant value is 'a' in the equation for the calibration dimming value, and the weight value for the local dimming resultant value is '(1−a)' in the equation for the calibration dimming value.

7. A liquid crystal display, comprising:

a liquid crystal panel;

a backlight unit that supplies light to the liquid crystal panel and has a plurality of light sources, the backlight unit being driven in a global dimming scheme and a local dimming scheme; and an image calibration unit that analyzes a low grayscale for an image data signal inputted to the liquid crystal panel and makes a weight value of one of a global dimming value and a local dimming value different from the other to generate a dimming value of the backlight unit, wherein the dimming value is defined in the following equation:

$$\dim(i,j)=\alpha\cdot\dim_{GD}+(1-\alpha)\cdot\dim_{LD}(i,j)$$

where 'dim(i, j)' refers to a dimming value of the backlight unit, 'dimGD' refers to the degree of the driven backlight unit upon global dimming, 'dimLD(i, j)' refers to the degree of the driven backlight unit according to the position of a light source upon local dimming, and 'a' has a relationship as follows: $0<a<1$, whereby the dimming value is a mixing of the global and local dimming values, and wherein when the image data signal is a motion image, the image calibration unit analyzes a low gray scale at a letterbox of the motion image to raise the weight value for the global dimming resultant value respective of the weight value for the local dimming resultant value.

8. The liquid crystal display of claim 7, wherein the weight value for the global dimming value is 'a' in the equation for the dimming value, and the weight value for the local dimming value is '(1−a)' in the equation for the dimming value.

9. A method of driving a liquid crystal display, the method comprising:

calculating a global dimming resultant value and a local dimming resultant value for an image data signal inputted to the liquid crystal panel;

analyzing an average picture level for each block with respect to the image data signal;

determining a convex combination parameter based on the global dimming resultant value, the local dimming resultant value, and the average picture level; and generating a calibration dimming value for the backlight unit and an image calibration value for the image data signal to control a backlight unit, wherein the calibration dimming value is defined in the following equation:

$$\dim(i,j)=\alpha\cdot\dim_{GD}+(1-\alpha)\cdot\dim_{LD}(i,j)$$

where 'dim(i, j)' refers to a dimming value of the backlight unit, 'dimGD' refers to the degree of the driven backlight unit upon global dimming, 'dimLD(i, j)' refers to the degree of the driven backlight unit according to the position of a light source upon local dimming, and 'a' has a relationship as follows: $0<a<1$, whereby the calibration dimming value is based on a mixing of the global and local dimming resultant values, wherein analyzing the average picture level includes calculating the average picture level and analyzing a difference value in the average picture level between neighboring blocks, wherein analyzing the average picture level includes increasing a weight value for the global dimming resultant value when the difference value in the average picture level between the neighboring blocks is large and increasing a weight value for the local dimming resultant value when the difference value in the average picture level between the neighboring blocks is small.

10. The method of claim 9, wherein $0<a\leq k$ (k is a real number more than 0 and less than 1) when the difference value is small and $k\leq a<1$ when the difference value is large.

11. The method of claim 9, wherein controlling the backlight unit includes calculating a per-block pixel calibration amount based on the calibration dimming value of the backlight unit and generating the image calibration value for each pixel.

12. The method of claim 9, wherein analyzing the average picture level includes, when the image data signal is a motion image, analyzing a low gray scale at a letterbox of the motion image to raise the weight value for the global dimming resultant value respective of the weight value for the local dimming resultant value.

13. The method of claim 9, wherein the weight value for the global dimming resultant value is 'a' in the equation for the calibration dimming value, and the weight value for the local dimming resultant value is '(1−a)' in the equation for the calibration dimming value.

* * * * *